US008002493B2

(12) United States Patent
Audet

(10) Patent No.: US 8,002,493 B2
(45) Date of Patent: Aug. 23, 2011

(54) FLEXIBLE ROUTE MARKER

(76) Inventor: Sylvain Audet, Quebec (CA)

( * ) Notice: Subject to any disclaimer, the term of this patent is extended or adjusted under 35 U.S.C. 154(b) by 0 days.

(21) Appl. No.: 12/657,504

(22) Filed: Jan. 22, 2010

(65) Prior Publication Data

US 2011/0182662 A1 Jul. 28, 2011

(51) Int. Cl.
*E01F 9/017* (2006.01)

(52) U.S. Cl. ..... 404/10; 40/608; 40/612; 116/63 R

(58) Field of Classification Search ..... 404/10; 40/608, 612; 116/63 R
See application file for complete search history.

(56) References Cited

U.S. PATENT DOCUMENTS

| | | | | | |
|---|---|---|---|---|---|
| 4,245,922 | A * | 1/1981 | Auriemma | ..... | 404/10 |
| 5,168,827 | A * | 12/1992 | Junker | ..... | 116/63 P |
| 5,483,917 | A * | 1/1996 | Walker | ..... | 116/63 P |
| 5,788,405 | A * | 8/1998 | Beard | ..... | 404/10 |
| 6,053,658 | A * | 4/2000 | Gibson, Jr. | ..... | 404/10 |
| 7,473,051 | B2 * | 1/2009 | Audet | ..... | 404/10 |
| 2008/0131201 | A1 * | 6/2008 | Audet | ..... | 404/10 |

* cited by examiner

*Primary Examiner* — Gary S Hartmann
(74) *Attorney, Agent, or Firm* — Eric Fincham

(57) ABSTRACT

A flexible marker post assembly having a base, first and second members of an elastomeric material secured to the base and extending upwardly therefrom, the first and second flexible members each having respective first and second side walls with a concave recess formed on each of the side walls, substantially rigid post mounted intermediate of an upper portion of the first and second flexible members with the post having a lower end secured to an upper portion of the first and second flexible members. The provision of concave recesses permits a better bending action when the post is struck at an angle.

11 Claims, 2 Drawing Sheets

FLEXIBLE ROUTE MARKER

FIELD OF THE INVENTION

The present invention relates to a route marker, and more particularly, relates to a improved route marker which has improved properties compared to existing route markers.

BACKGROUND OF THE INVENTION

The use of posts as traffic delineators is well know in the art. These traffic delineators identify areas of the highway or other area on which autos should not travel. Such traffic delineators are frequently used to separate bicycle or walking paths from other vehicular traffic. Various proposals have been advanced in the art ranging from rigid posts having reflective material thereon to flexible posts. The use of flexible posts is most desirable since the traffic delineators are inevitably impacted by vehicles. A rigid post must then be replaced and the vehicle repaired.

Due to the above reasons, the use of flexible posts is desired. However, many such flexible posts have not been designed to withstand impact from a vehicle while at the same time providing highly visible marking. However, one such traffic delineator which has received a high degree of acceptance is shown in U.S. Pat. No. 7,473,051 the teachings of which are hereby incorporated by reference. The traffic delineator of the above referred to US patent has been found to be flexible while strong enough to withstand multiple impacts without damage to the vehicle or to the post.

SUMMARY OF THE INVENTION

It is an object of the present invention to provide an improved traffic delineator post which has a high degree of flexibility irrespective of the direction in which the post is impacted by a vehicle.

According to one aspect of the present invention, there is provided a flexible marker post assembly comprising a base, first and second flexible markers of an elastomeric material secured to the base and extending upwardly therefrom, the first and second flexible members each having respective first and second side walls, a concave recess formed in each of the side walls of the first and second flexible members, a substantially rigid post mounted intermediate of an upper portion of the first and second flexible members, the post having a lower end thereof secured to an upper portion of the first and second flexible members, the post being substantially coplanar with the first and second flexible members, the post having a reflective material thereon, the first and second flexible members having a bending zone located between where the flexible members are secured to the base and where the lower end of the post extends.

The flexible route marker of the present invention, as above stated, includes first and second flexible members secured to a base and extending upwardly thereto. The flexible members sandwich a post which is mounted intermediate of the first and second flexible members. The flexible members are preferably formed of an elastomeric material and most preferably are formed of a rubber material. The flexible members are sized to provide the desired resiliency and to this end, the material itself may be varied depending upon the requirements of the particular application. Thus, the flexible members can be made more or less flexible depending upon the impact which is anticipated to be received and the frequency of the impacts. Thus, the size (height, width and thickness) of the substantially rigid post can influence the flexible members.

The post mounted intermediate of the flexible members preferably has a first side which is concave and a second side which is convex in configuration. An impact resistant plastic material is one of the preferred materials and will have a greater stiffness than the flexible support to thereby allow the flexible support to bend upon an impact force being applied thereto. After the impact force is removed, the post will resume its normal upright position.

The post preferably incorporates reflective material, the reflective material being incorporated on the convex and concave side of the post. Such reflective material is well known in the art and any suitable material may be utilized though a reflective material providing a yellow reflection is preferred. In such an instance, a post may be black with the yellow reflective material being secured thereto. Other colors such as white, yellow, green, red, orange, etc., may also be utilized.

The base is formed of a metallic material such as steel. The base is arranged to be secured to a substrate and to sandwich the flexible members.

The present invention provides for concave recesses formed in the flexible members to permit a twisting action when the post is struck. Preferably, the convex recesses are located below a bending zone which is formed to permit bending of the post.

BRIEF DESCRIPTION OF THE DRAWINGS

Having generally described the invention, reference will be made to the accompanying drawings illustrating an embodiment thereof, in which.

DETAILED DESCRIPTION OF THE INVENTION

Figure 1:
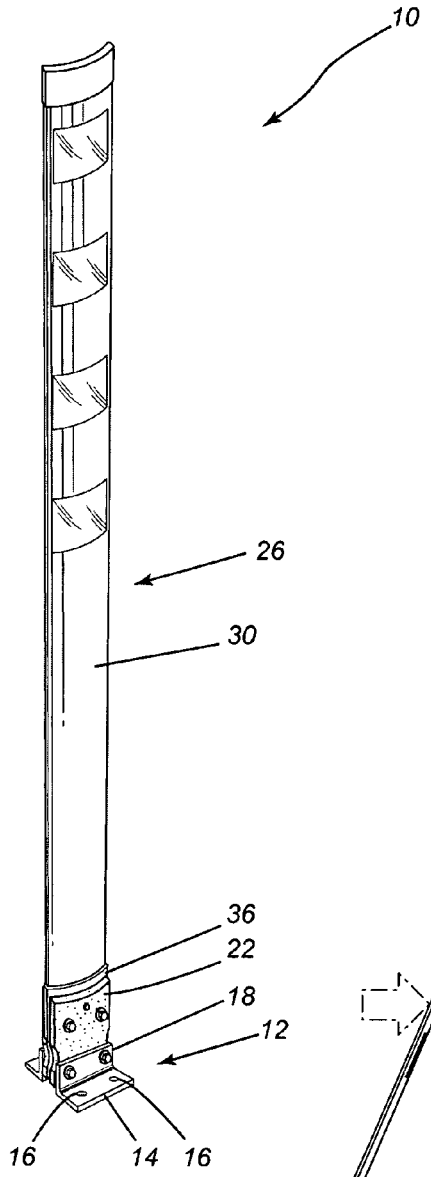
FIG. 1 is a perspective view of a flexible marker post according to the present invention.
Figure 2:
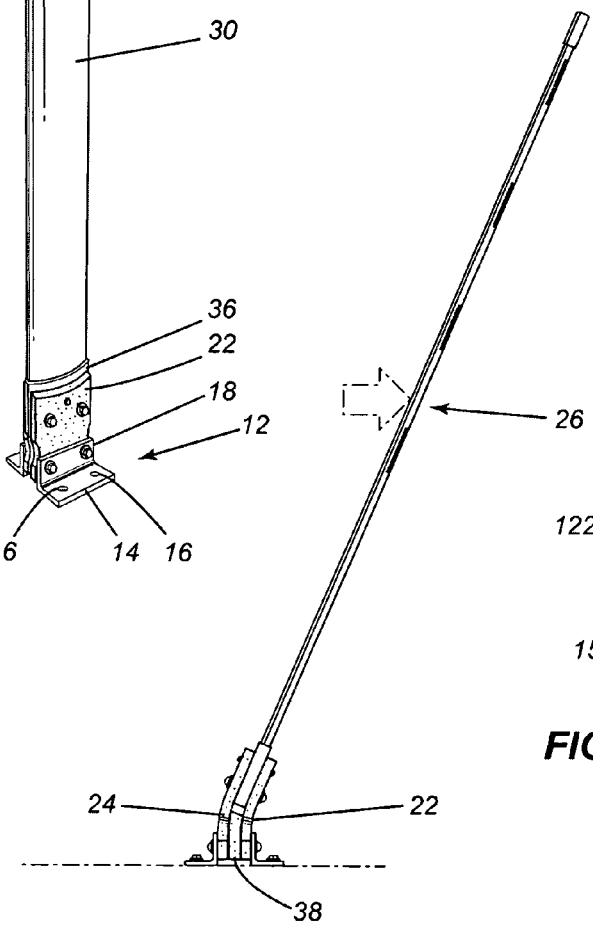
FIG. 2 is a side elevational view showing the flexible marker post yielding upon an impact force being applied thereto.

Referring to the drawings in greater detail and by reference characters thereto, there is illustrated in FIG. 1 a flexible route marker which is generally designated by reference numeral 10.

Route marker 10 has securement means 12 for securing the route marker to a substrate. The substrate may be any conventional and would generally include the ground, asphalt, concrete, etc. Each securement means comprises a base 14 having apertures 16 therein and an upright portion 18. Between the two upright portions 18, there are provided a pair of flexible members 22 and 24. As previously stated, flexible members 22 and 24 are formed of a known suitable material such as rubber or other desired elastomeric material.

A post 26 is secured between flexible members 22 and 24 and in the preferred illustrated embodiment, has a concave side 28 and a convex side 30. A plurality of reflective material portions 32 are applied to the convex side 30 and concave side 28. The concave side 28 is the side generally facing vehicular traffic.

Post 26 is provided with an upper reinforcing cap 34 and a lower reinforcing cap 36 which are preferably formed of a polyurethane material. Caps 34 and 36 have been found to reduce the stress on post 26 and enhance the lifespan thereof. Caps 34 and 36 completely encapsulate the upper and lower ends respectively.

For assembling the route marker, bolts 40 are used to secure the two uprights 18 together. A filler 38 may be utilized to provide proper spacing with filler 38 being of a thickness appropriate to maintain post 26 under a desired degree of compression. Bolts 42 in turn are used to secure post 26 between flexible markers 22 and 24. There is a gap 41 formed between flexible members 22 and 24 to provide a bending zone.

Figure 7:
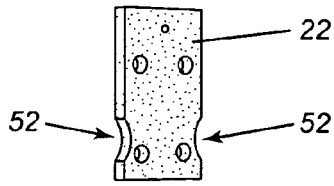
FIG. 7 is a perspective view of one of the flexible members.

Flexible member 22 is illustrated in FIG. 7 and it would be noted that there are provided a pair of concave recesses 50, 52, one being located on each side of flexible member 22. Flexible member 24 has a similar structure.

Preferably, the recesses 50, 52 are located such that they are below the bending zone formed by gap 41. Concave recesses 50, 52 permit flexible member 22 to bend in a twisting manner to better absorb any shock coming from the side or an angle.

Figure 8:
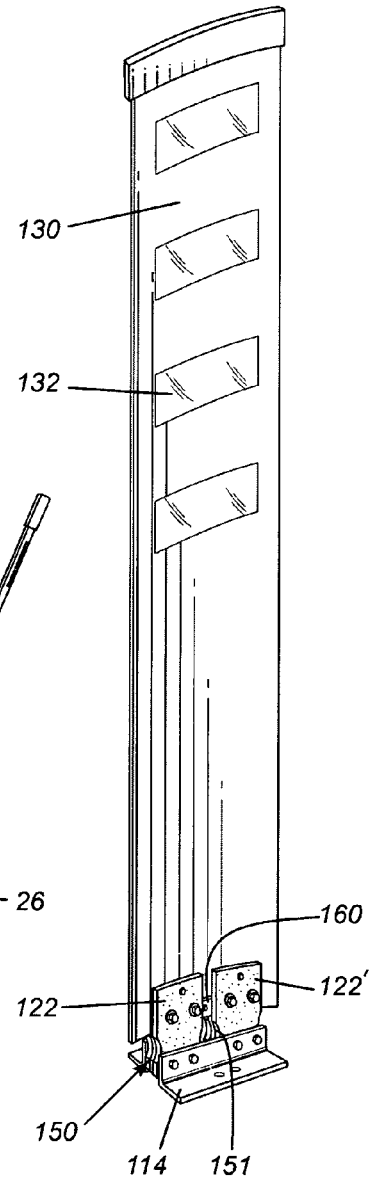
FIG. 8 is a perspective view of a further embodiment of the present invention.
Figure 3:
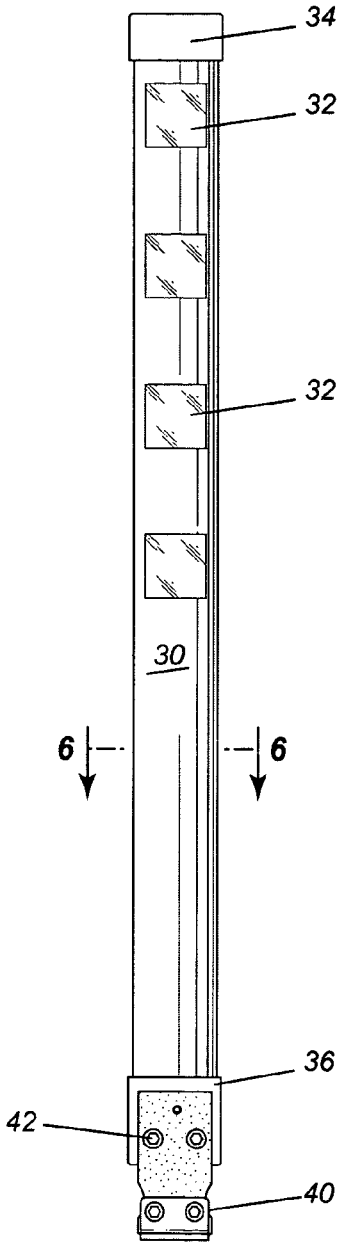
FIG. 3 is a front elevational view of the flexible marker post.
Figure 4:
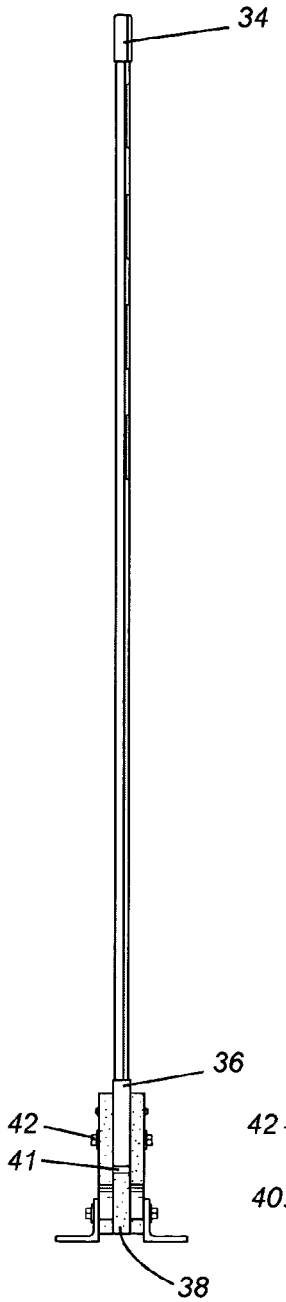
FIG. 4 is a side elevational view thereof.
Figure 5:
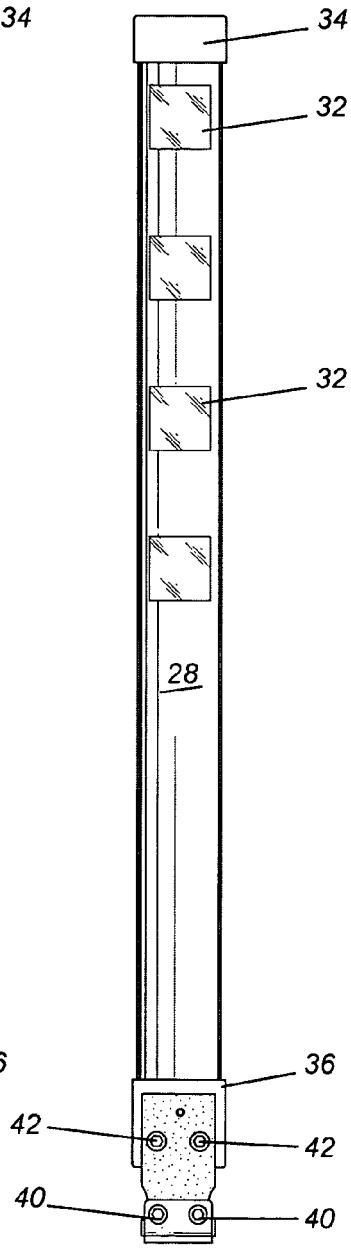
FIG. 5 is a rear elevational view thereof.
Figure 6:
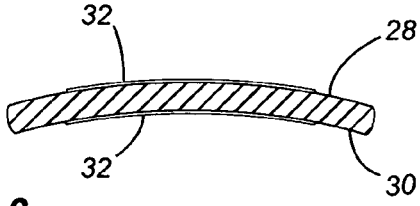
FIG. 6 is across-sectional view taken along the lines 6-6 of FIG. 3.

In the embodiment of FIG. 8, a similar arrangement to that previously described is shown. However, in this arrangement, wherein reference numerals in the 100's are employed for similar components, each side has a pair of flexible members 122, 122'. Flexible member 122 has a pair of concave recesses 150, 151. Flexible member 122' has a similar structure.

In the illustrated arrangement, a connecting member 160 may extend between flexible members 122, 122'.

It will be understood that the above described embodiment is for purposes of illustration only and that changes and modifications may be made thereto without departing from the spirit and scope of the invention.

I claim:

1. A flexible marker post assembly comprising:

a base;

first and second flexible markers of an elastomeric material secured to said base and extending upwardly therefrom, said first and second flexible members each having respective first and second side walls, a concave recess formed in each of said side walls of said first and second flexible members;

a substantially rigid post mounted intermediate of an upper portion of said first and second flexible members, said post having a lower end thereof secured to an upper portion of said first and second flexible members, said post being substantially coplanar with said first and second flexible members, said post having a reflective material thereon;

said first and second flexible members having a bending zone located between where said flexible members are secured to said base and where said lower end of said post extends; said concave recesses having a C-shaped configuration, said concave recesses being located in said bending zone so as to permit a lateral displacement of said post.

2. The flexible marker post assembly of claim 1 wherein said post has a concave/convex configuration.

3. The flexible marker post assembly of claim 1 wherein said post is formed of a fibre glass material.

4. The flexible marker post assembly of claim 1 wherein said substantially rigid post has an upper reinforcing portion encapsulating an upper end thereof and a lower reinforcing portion encapsulating a lower end of said post.

5. The flexible post assembly of claim 4 wherein said lower reinforcing portion extends from a lower end of said post to a point above said first and second flexible members.

6. The flexible marker post assembly of claim 4 wherein said reinforcing portions are formed of a polyurethane material.

7. The flexible marker post assembly of claim 1 wherein said first and second flexible members are formed from an elastomeric material.

8. The flexible marker post assembly of claim 7 wherein said elastomeric material is rubber.

9. The flexible marker post assembly of claim 1 further included a flexible filler located intermediate a lower portion of said first and second flexible members.

10. The flexible marker post assembly of claim 1 wherein said base comprises first and second brackets, each of said brackets having a horizontal portion for securement to a substrate and a vertical portion for securement to said flexible members, said lower end of said post and said lower reinforcing portion being located between said flexible members.

11. The flexible marker post assembly of claim 10 wherein said lower reinforcing portion extends from said lower end of said post upwardly to a point above where said post is retained by said first and second flexible members.

* * * * *